United States Patent [19]

Mohar

[11] 4,363,454

[45] Dec. 14, 1982

[54] TISSUE ROLL STORAGE AND DISPENSER APPARATUS

[76] Inventor: Louis Mohar, 5713 N. 72 St., Milwaukee, Wis. 53218

[21] Appl. No.: 179,972

[22] Filed: Aug. 21, 1980

[51] Int. Cl.[3] ..... B65H 19/00; B65H 19/04

[52] U.S. Cl. ..... 242/55.53; 242/55.3

[58] Field of Search ..... 242/55.2, 55.3, 55.53, 242/55.42, 55.54, 129.5; 312/38–40

[56] References Cited

U.S. PATENT DOCUMENTS

| | | | |
|---|---|---|---|
| 2,603,427 | 7/1952 | Holmes | 242/55.3 |
| 2,991,951 | 7/1961 | Carroll | 242/55.42 |
| 3,039,709 | 6/1962 | Bolger | 242/55.3 |
| 3,130,932 | 4/1964 | Pena | 242/55.3 |
| 3,217,998 | 11/1965 | Schwartz | 242/55.42 |
| 3,266,742 | 8/1966 | Pena | 242/55.3 |
| 3,295,777 | 1/1967 | Carroll | 242/55.3 |

*Primary Examiner*—Leonard D. Christian

[57] ABSTRACT

Toilet tissue roll storage and dispenser apparatus comprises an open-bottomed cabinet having a storage space, a roll support and dispenser device pivotably mounted in the cabinet below the storage space and roll support plate and a cylindrical roll holder below the support plate, and an operating handle accessible from the exterior of the cabinet for pivotably moving the device 90 degrees between a roll-dispensing position and a roll-receiving position. In the roll-dispensing position, rolls of tissue are stacked one on top of another in the storage space with their axes in vertical alignment on the roll support plate. The device is then swung upwardly to roll-receiving position by means of the operating handle, causing the roll support plate to tilt and lift the stack of rolls upward in the storage space until the free end of the cylindrical roll holder engages the core of the lowermost roll in the stack, whereupon that roll drops onto the roll holder. The device is then swung to roll-dispensing position by means of the operating handle wherein the roll on the roll holder is horizontally disposed and accessible through the open bottom of the cabinet and the remaining rolls slide downward to rest upon the support plate. A latch is provided for preventing the device from being tilted upward to receive a new roll until the depleted roll core is axially removed through an access hole in the side of the cabinet.

10 Claims, 16 Drawing Figures

TISSUE ROLL STORAGE AND DISPENSER APPARATUS

BACKGROUND OF THE INVENTION

1. Field of Use

This invention relates generally to apparatus for storing and dispensing rolls of toilet tissue or the like.

2. Description of the Prior Art

A wide variety of apparatus and equipment for storing and dispensing rolls of tissue, such as toilet tissue or the like, are known and in use. In commercial establishments or public facilities where tissue usage is high, it is preferable to employ a dispenser of a type wherein several rolls, in addition to the one in use, are stored in readiness for use when the one in use is depleted or exhausted. Furthermore, since the tissue wound on the stiff hollow core is flimsy in nature, it is more convenient from the user's standpoint that the roll in use be disposed so that the roll axis is generally horizontal. U.S. Pat. No. 3,295,777 shows apparatus of a type wherein a plurality of tissue rolls are stacked one above another with their axes vertical and having a spindle on which the roll in use is also vertically disposed. U.S. Pat. Nos. 3,101,181; 2,993,658; 2,603,427; 2,564,539 and 2,495,252 each show forms of apparatus wherein the roll in use is horizontally disposed but the stored rolls are also horizontally disposed one above the other. Such horizontally stacked rolls tend to go "out of round" and can pose a risk of jamming or "hanging up" in the dispensing mechanism. Furthermore, many prior art forms of apparatus make no provision to prevent removal of an undepleted roll in use and thus stop pilfering.

SUMMARY OF THE INVENTION

In accordance with the invention there is provided a storage and dispenser apparatus for tissue rolls, such as toilet tissue rolls. The apparatus is especially well-adapted for use with rolls of tissue, such as toilet tissue, which comprise a stiff hollow core having tissue wound thereon but could be used with rolls which have a central hole but no separate core. The rolls in storage are stacked one upon another with their core axes generally vertically disposed and in axial alignment. The roll disposed for use has its core axis in generally horizontal disposition and is disposed on the cylindrical roll holder upon which it is free to rotate. The apparatus comprises a cabinet defining a storage space wherein a plurality of tissue rolls can be slidably stored one on top of another with their axes in vertical alignment, the cabinet having an opening at the bottom thereof for user access to a horizontally disposed roll in use. A support and dispenser device is located in the cabinet below the storage space and includes a support member on which a lowermost tissue roll in the storage space can rest and further includes a roll holder spaced from the support member and on which a tissue roll can be disposed. The support member and roll holder each have a free end. Means are provided for pivotably mounting the device in the cabinet to enable the device to be movable between a roll-dispensing position wherein the support member and the roll holder are generally horizontally disposed with the roll holder beneath the support member, and a roll-receiving position wherein the support member and the roll holder are generally vertically disposed with their free ends extending upwardly. Operating means such as a lever is connected to the device and extends outwardly of the cabinet for selectively moving the device between the roll-dispensing position and the roll-receiving position. Alignment means are provided in the storage space for aligning the core of the lowermost tissue roll in the storage space with the roll holder when the latter is in roll-receiving position. The alignment means are movable to enable passage therepast of a tissue roll on the roll holder as the latter moves from roll-receiving position to roll-dispensing position. The cabinet includes an opening aligned with the roll holder when the latter is in roll-dispensing position to enable removal of a core member of a tissue roll when the roll is exhausted. A latch is provided for preventing the device from being tilted upward again to receive a new roll until the core of the depleted roll is axially removed from the roll holder through an access hole in the side of the cabinet.

With the device in the roll-dispensing position, one or more rolls of tissue are stacked one on top of another in the storage space with their axes in vertical alignment and are supported on the roll support plate. The device is then swung upwardly to roll-receiving position by means of the operating handle, thereby causing the roll support plate to tilt upward and lift the stack of rolls upward in the storage space until the free end of the cylindrical roll holder, also tilting upward, engages the hollow core of the lowermost roll in the stack, whereupon that roll drops onto the roll holder. The device is then swung downward 90 degress to roll-dispensing position by means of the operating handle wherein the roll on the roll holder is horizontally disposed and accessible for use through the open bottom of the cabinet and the remaining stored rolls slide downward in the storage space to rest upon the support plate.

Apparatus in accordance with the invention offers several advantages over the prior art. For example, it enables the rolls to be stored one on top of another with their axes vertical, thereby eliminating deformation or crushing of the rolls. Yet it enables the roll in use to be horizontally disposed, which is most convenient and practical for the user. The apparatus prevents removal of the roll in use and also prevents access to the stored rolls, thereby reducing waste and pilferage. The apparatus is simple and economical to fabricate and is trouble-free in operation. Other objects and advantages will hereinafter appear.

DESCRIPTION OF PREFERRED EMBODIMENTS

Figure 5:
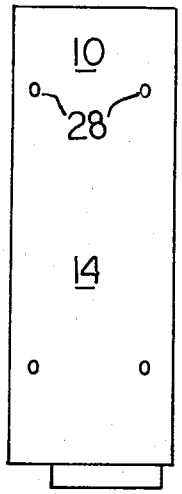
FIG. 5 is an elevational view of the rear side of the apparatus of FIGS. 1, 2, 3 and 4.

Referring to FIGS. 1, 2, 3, 4 and 5, the numeral 10 designates apparatus in accordance with the invention for storing one or more rolls of toilet tissue or the like and for dispensing the stored rolls individually for use. The apparatus 10 comprises a cabinet 12, preferably fabricated of sheet metal, and having a rear side 14, a pair of spaced apart lateral sides 16 and 18, a top side 20 and a front side 22, which could be a door (not shown) is secured by hinges to lateral side 16 and provided, for example, with a lock (not shown). The bottom of cabinet 12 is open and provides user access to a roll of tissue which is in use. As FIG. 5 shows, rear side 14 is provided with mounting holes 28 for accommodating screws or bolts (not shown) for securing the cabinet 12 in vertical position on a wall surface (not shown). The front side 22 of cabinet 12 is provided with a hole 30 (FIG. 12) for accommodating an operating lever or handle 32 hereinafter described. The opposite lateral side 18 of cabinet 12 is provided with a hole or opening 34 for accommodating removal and passage therethrough of the core C of a depleted roll of tissue.

Figure 1:
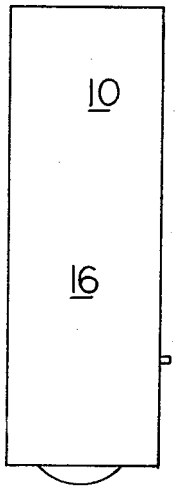
FIG. 1 is a side elevational view of one side of tissue roll storage apparatus in accordance with the present invention.
Figure 2:
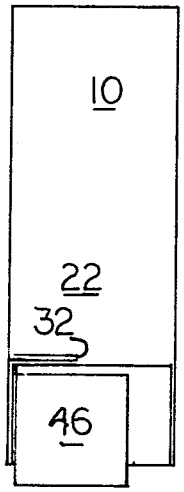
FIG. 2 is a front elevational view of the apparatus of FIG. 1.
Figure 3:
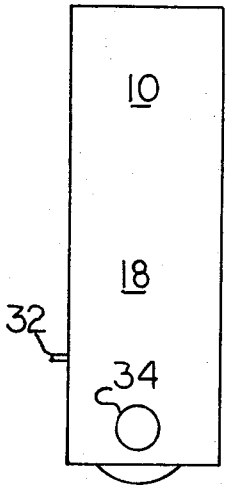
FIG. 3 is a side elevational view of the other side of the apparatus of FIGS. 1 and 2.
Figure 4:
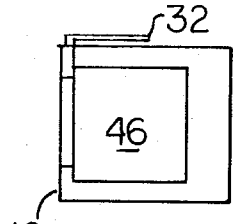
FIGS. 4 and 4A are bottom and top plan views, respectively, of the apparatus of FIGS. 1, 2 and 3.
Figure 4A:
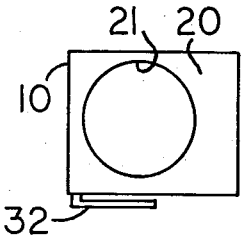

If preferred, instead of the front side of cabinet 12 serving as the door 22 which provides loading access to the cabinet 12, the top side 20 is provided with a loading hole 21 through which rolls are inserted, as FIG. 4A shows.

Figure 6:
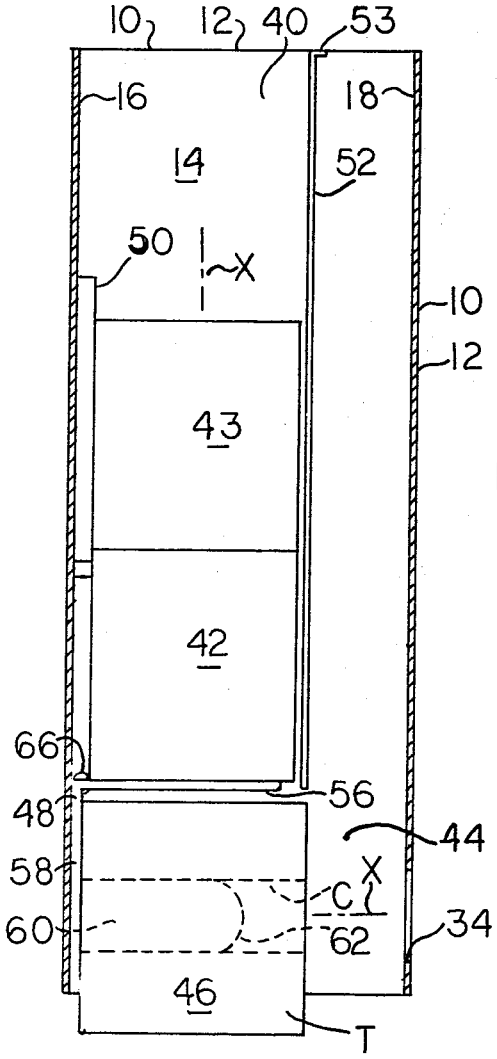
FIG. 6 is an enlarged front elevational view of the apparatus with the door open to show interior details.

As FIG. 6 shows, cabinet 12 defines a space 40 therewithin in which a plurality of rolls of tissue, designated 42 and 43, are stored and further defines another contiguous space 44 therebelow in which a roll of tissue 46 is disposed in readiness for use on a roll support and dispenser device or unit 48.

Once inserted the rolls cannot be withdrawn through hole 21 without damage.

Figure 10:
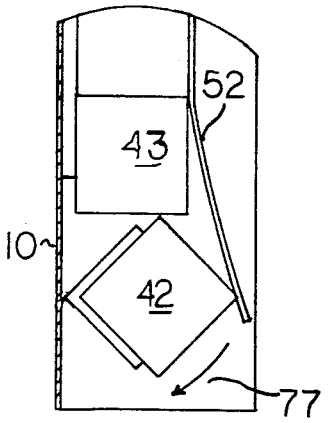

Each roll 42, 43, and 46 comprises a core C having a longitudinal axis X on which the tissue T is wound. The rolls 42 and 43 are arranged one above the other with their axes X vertically disposed and in axial alignment with each other. The roll 46 is arranged so that its axis X is horizontally disposed. The rolls 42 and 43 are understood to be slidable vertically (upwardly and downwardly) in space 40 and are maintained in a predetermined axial position within the space by means of the rear side 14, the front side 22, a spacer block 50 rigidly secured to the inside of lateral side 16, and by a resiliently movable guide member 52 which is secured at its upper end to cabinet 12 as by welding at 53. Member 52 extends downwardly along the inside of lateral side 18 and exerts a slight pressure against at least the lowermost stored roll 42 to hold it in a predetermined position axially. Member 42 is adapted to flex or move to the right (with respect to FIGS. 6 and 10) to enable roll 42 to be swung down to the in-use position, as hereinafter explained.

As FIGS. 6, 7, 8, 9, 10, 11 and 12 show, the unit 48 comprises an upper member 56 in the form of a flat plate having a free edge 55 and rounded corners 57, a depending member 58 in the form of a flat plate which is connected at one of its ends to one end of upper member 56, and a roll support member 60 in the form of a cylinder which is connected at one end to a surface of depending member 58. The other or free end of roll support member 60 is preferably rounded as at 62 to facilitate its engagement with and insertion into the hollow core C of roll 42, as hereinafter explained. Roll support member 60 is generally parallel to and spaced from upper member 56 a sufficient distance to accommodate roll thickness.

Figure 9:
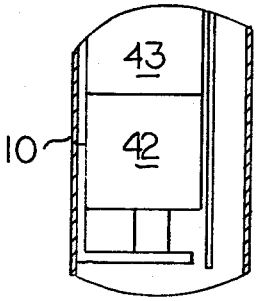
Figure 11:
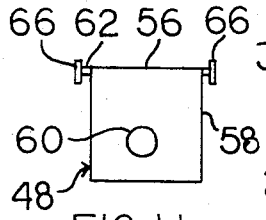
FIG. 11 is an end elevational view of the device shown in FIG. 6.
Figure 12:
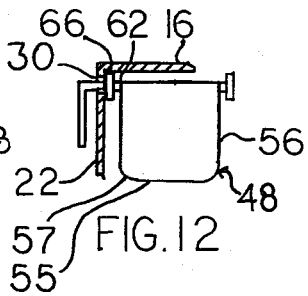
FIG. 12 is a top plan view of the device shown in FIG. 11.

The unit 48 is provided with hinge means which enable it to be swung between one position, namely, a roll-dispensing position shown in FIG. 6, and another position, namely, a roll-receiving position shown in FIG. 9. As FIGS. 11 and 12 show, hinge means 60 comprises, for example, a pair of pins 62 which extend horizontally from opposite sides of unit 48 near the junction of members 56 and 58 which are rigidly secured together. The pins 62 engage pin-receiving holes 64 in a pair of spaced apart brackets 66 which are rigidly secured to the inside of lateral sides 22 and 14 of cabinet 12.

Figure 7:
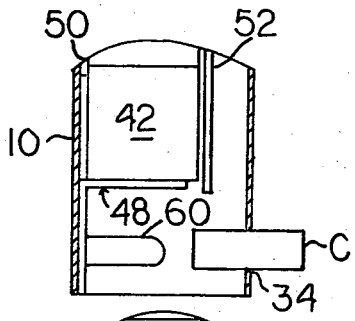
FIGS. 7, 8, 9 and 10 are views similar to FIG. 6 but showing a movable roll support and dispenser device therein in various operating positions.
Figure 8:
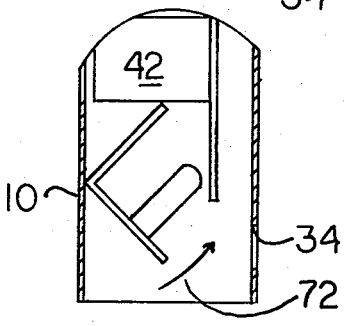

The roll dispenser unit 48 is swingable between its two positions by means of lever 32 which has one end rigidly secured by welding at 70 to the upper member 56, although it could be secured elsewhere on unit 48 and take a form other than that shown. Lever 32 extends through hole 30 in front side 22 of cabinet 12 and, when fully raised as comparison of FIGS. 7, 8 and 9 shows, causes unit 48 to swing upward 90 degrees in the direction of arrow 72 shown in FIG. 8 into roll-receiving position.

Figure 13:
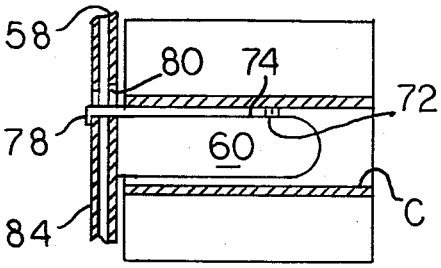
FIG. 13 is a side elevational of a modified device and showing latch means thereon in latched condition.
Figure 14:
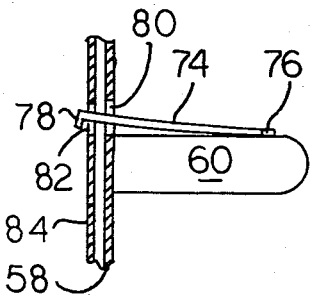
FIG. 14 is a view similar to FIG. 13 but showing the latch means in unlatched condition.
Figure 15:
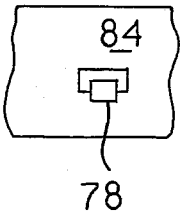
FIG. 15 is an end view of a portion of the latch means of FIGS. 13 and 14.

FIGS. 13, 14 and 15 show an embodiment of the invention wherein the unit 48 is provided with latching means for preventing unit 48 from being pivoted upward from roll-dispensing position to roll-receiving position until the core C of a depleted roll of tissue is removed from the roll support member or spindle 60. Such latching means comprise, for example, an elongated resilient upwardly bowed or sprung member 74 which has one end secured to roll support member 60 as by a screw or rivet 76 and which is provided at its other end with a downwardly depending flange or tang 78. Resilient member 74 extends through a slot or hole 80 in depending member 58 of unit 48 and is releasably engageable in an opening 82 in a bracket 84 which is secured to the inside of lateral side 16 of cabinet 12. As comparison of FIGS. 13 and 14 shows, when a core C is disposed on member 60, resilient member 74 is flattened or depressed and its tang 78 engages bracket 84 thereby preventing unit 48 from being swung upward. However, when core C is removed, tang 78 disengages from bracket 84 and unit 48 can be swung upward to receive another roll. It is to be understood that resilient member 74 is sufficiently flexible so that when a roll of tissue is first emplaced thereon tang 78 can engage the hole 82 in bracket 84 as unit 48 is swung down into dispensing position (see FIG. 10). If preferred, other forms of latching means could be provided.

The apparatus hereinbefore described operates as follows. Assume that the apparatus is initially in the condition shown in FIG. 6. Further assume that the roll 46 is finally depleted and that the core C thereof is manually withdrawn through opening 34 as shown in FIG. 7. In the embodiment shown in FIGS. 13, 14 and 15, removal of core C disengages the latching means tang 78. Unit 48 is then swung upward in the direction of the arrow 72 in FIG. 8 by means of upward manual movement of lever 32 in the direction of arrow 72. As unit 48 swings upward, the free forward edge 55 of upper member 56 engages the lower end of lowermost stored roll 42 and gradually forces the roll 42 (and roll 43 thereon) to slide upward in the direction shown in FIG. 8. When upper member 56 is fully vertical, edge 55 moves past the lower end of roll 42 and cylindrical roll support member 60 is in axial alignment with the opening in hollow core C of roll 42, whereupon roll 42 slides downwardly vertically in the direction shown in FIG. 9 under the force of gravity and seats against member 58 of unit 48. When roll 42 is thus seated, lever 32 is swung down in the direction of arrow 77 in FIG 10, thereby causing unit 48 to move downward in the direction of arrow 77 in FIG. 10. As this occurs, the upper edge of roll 42 bears against the resiliently movable guide member 52 causing the latter to shift rightward (with respect to FIG. 10) to allow clearance for downward movement of roll 42. Meanwhile, edge 55 of upper member 56 of unit 48 engages the lower end of the next stored roll 43 and holds it in non-interfering relationship. When unit 48 with roll 42 thereon assumes the position shown in FIG. 6, roll 42 is horizontally disposed and ready for use and roll 43 rests on top of member 56.

If apparatus 10 embodies the latch means of FIGS. 13, 14 and 15, unit 48 cannot be swung upward again until core C is removed. However, even if such latch means are not employed, attempts to swing unit 48 upward may be possible but serve no useful purpose.

I claim:

1. Storage and dispenser apparatus for tissue rolls having a hollow axial core comprising:

means defining a storage space wherein a plurality of said tissue rolls can be slidably stored in axially vertical position one of top of another;

a support and dispenser device pivotably mounted below said space and including a support member on which a tissue roll can rest and a roll holder spaced from said support member, said support member and roll holder each having a free end;

and means for pivotably moving said device between a roll-dispensing position wherein said support member and said roll holder are generally horizontally disposed with the roll holder beneath the support member and a roll-receiving position wherein said support member and said roll holder are generally vertically disposed with their free ends extending upwardly.

2. Apparatus according to claim 1 including alignment means in said storage space for aligning the core of the lowermost tisssue roll in said storage space with said roll holder when the latter is in roll-receiving position.

3. Apparatus according to claim 2 wherein said alignment means is movable to enable passage therepast of a tissue roll on said roll holder as the latter moves from roll-receiving position to roll-dispensing position.

4. Apparatus according to claims 1 or 2 or 3 including latch means for preventing said device from being moved from roll-dispensing position to roll-receiving position while any portion of a tissue roll is disposed on said roll holder.

5. Storage and dispenser apparatus for tissue rolls having hollow axial core members comprising:

a cabinet defining a storage space wherein a plurality of tissue rolls can be slidably stored one on top of another with their axes vertical, said cabinet having an opening at the bottom thereof;

a support and dispenser device in said cabinet below said storage space and including a support member on which a lowermost tissue roll in said storage space can rest and further including a roll holder spaced from said support member and on which a tissue roll can be disposed, said support member and roll holder each having a free end;

means for pivotably mounting said device in said cabinet to enable said device to be movable between a roll-dispensing position wherein said support member and said roll holder are generally horizontally disposed with the roll holder beneath the support member and a roll-receiving position wherein said support member and said roll holder are generally vertically disposed with their free ends extending upwardly;

means connected to said device and extending outwardly of said cabinet for selectively moving said device between said roll-dispensing position and said roll-receiving position;

and alignment means in said storage space for aligning the core of the lowermost tissue roll in said storage space with said roll holder when the latter is in roll-receiving position, said alignment means being movable to enable passage therepast of a tissue roll on said roll holder as the latter moves from roll-receiving position to roll-dispensing position.

6. Apparatus according to claim 5 wherein said cabinet includes and opening aligned with said roll holder when the latter is in roll-dispensing position to enable removal of a core member of a tissue roll when the roll is exhausted.

7. Apparatus according to claim 5 wherein said alignment means includes a movable member connected to said cabinet and means for biasing said movable member against at least the lowermost tissue roll in said storage space.

8. Apparatus according to claim 5 including a hole affording access to said storage space.

9. Apparatus according to claim 5 or 6 including latch means for preventing said device from being moved from roll-dispensing position to roll-receiving position while a core is disposed on said roll holder.

10. Apparatus according to claim 9 wherein said latch means includes a movable latch member on said roll holder releasably engageable with latch-engaging means on said cabinet.

* * * * *

Notice of Adverse Decision in Interference

In Interference No. 101,287, involving Patent No. 4,363,454, L. Mohar, TISSUE ROLL STORAGE AND DISPENSER APPARATUS, final judgment adverse to the patentee was rendered Apr. 22, 1986, as to claim 1.

[*Official Gazette October 7, 1986.*]